US010916395B2

(12) United States Patent
Palmer et al.

(10) Patent No.: US 10,916,395 B2
(45) Date of Patent: Feb. 9, 2021

(54) SWITCH

(71) Applicant: INTROL IP LIMITED, Hamilton (NZ)

(72) Inventors: Andrew Joseph Palmer, Hamilton (NZ); Samuel James Logan, Hamilton (NZ)

(73) Assignee: Maggma Group IP Limited, Cambridge (NZ)

( * ) Notice: Subject to any disclaimer, the term of this patent is extended or adjusted under 35 U.S.C. 154(b) by 0 days.

(21) Appl. No.: 16/634,392

(22) PCT Filed: Jul. 27, 2018

(86) PCT No.: PCT/NZ2018/050105
§ 371 (c)(1),
(2) Date: Jan. 27, 2020

(87) PCT Pub. No.: WO2019/022622
PCT Pub. Date: Jan. 31, 2019

(65) Prior Publication Data

US 2020/0381201 A1 Dec. 3, 2020

(30) Foreign Application Priority Data

Jul. 28, 2017 (NZ) ..... 734124

(51) Int. Cl.
*H01H 37/66* (2006.01)
*H01H 36/00* (2006.01)
*H01H 37/52* (2006.01)

(52) U.S. Cl.
CPC ..... *H01H 37/66* (2013.01); *H01H 36/0073* (2013.01); *H01H 37/52* (2013.01);
(Continued)

(58) Field of Classification Search
CPC .... H01H 37/66; H01H 37/52; H01H 36/0073; H01H 2037/526; H01H 2036/0093
See application file for complete search history.

(56) References Cited

U.S. PATENT DOCUMENTS 2,575,086 A * 11/1951 Atchison ..... F16K 31/086 251/65
2,718,569 A * 9/1955 Johnston ..... H01H 71/142 335/208

(Continued)

OTHER PUBLICATIONS

International Search Report and Written Opinion for PCT/NZ2018/050105, dated Oct. 30, 2018.

(Continued)

*Primary Examiner* — Mohamad A Musleh
(74) *Attorney, Agent, or Firm* — Pilloff Passino & Cosenza LLP; Martin J. Cosenza

(57) ABSTRACT

The present invention relates to a switch and has particular application in temperature regulation devices used in domestic and commercial electrical appliances such as stoves, ovens or the like. It includes an arrangement of a pair of arms that co-operate with a biasing means in combination with magnetic components provided on each of the arms. This arrangement does away with the need for the switch to use relatively expensive bi-metallic components and which may be prone to arcing and potential damage to or fusing of the contacts of the switch.

24 Claims, 11 Drawing Sheets

(52) U.S. Cl.
CPC ..... *H01H 2036/0093* (2013.01); *H01H 2037/526* (2013.01)

(56) References Cited

U.S. PATENT DOCUMENTS

| | | | | | |
|---|---|---|---|---|---|
| 2,960,588 | A | | 11/1960 | Anderson et al. | |
| 3,009,047 | A | | 11/1961 | Simmons | |
| 3,110,789 | A | | 11/1963 | Hild | |
| 3,566,225 | A | * | 2/1971 | Erik Kurt Poulsen | H02K 17/30 318/792 |
| 3,760,310 | A | | 9/1973 | Carson | |
| 3,858,131 | A | * | 12/1974 | Larsson | H01H 35/06 335/136 |
| 3,905,003 | A | | 9/1975 | Rosenberg et al. | |
| 4,745,385 | A | | 5/1988 | Rossi | |

OTHER PUBLICATIONS

International Preliminary Report on Patentability for PCT/NZ2018/050105, dated Jun. 26, 2019.

* cited by examiner

SWITCH

STATEMENT OF CORRESPONDING APPLICATIONS

This application is based on the provisional specification filed in relation to New Zealand Patent Application No. 734124, the entire contents of which are incorporated herein by reference.

TECHNICAL FIELD

The present invention relates to a switch. The invention has particular application in temperature regulation devices used in domestic and commercial electrical appliances such as stoves, ovens or the like. However, this is not meant to be limiting and the invention may have application to the control and regulation of other electrical devices.

BACKGROUND ART

Temperature regulation is important in many appliances used in daily life. Such appliances can range from ovens and stovetops, to refrigerators, heaters and hot water cylinders. In many of these appliances there is the potential for safety concerns if the temperature regulating device was to fail.

One common method of regulating temperature is to use bi-metallic components. Bi-metallic components combine two distinct layers of metals with differing rates of thermal expansion. As the component is heated or cooled, the layer of metal with the higher coefficient of thermal expansion expands faster than its counterpart, resulting in an overall distortion or displacement of the component. This temperature dependent displacement can then be used to open or close a circuit and hence regulate temperature.

A complicating factor is that it is desirable for temperature regulation circuits to behave in the same manner irrespective of the ambient temperature. For example, a household fridge or freezer should keep its internal temperature reasonably constant irrespective of changes to the ambient temperature. Bi-metallic components are again used to provide this ambient temperature compensation.

However, the use of bi-metallic components has several disadvantages. The displacement of a bi-metallic component depends on its length and the ratio of thermal expansions of the metals used therein. In some cases, to achieve the desired degree of displacement, significant lengths of bi-metallic material are required.

Alternatively, the materials for the bi-metallic components may be selected such that they have significantly different coefficients of thermal expansion. This however may increase the overall cost of the bi-metallic component.

Furthermore, where bi-metallic components are used for temperature control, the making and breaking of the electrical current may occur relatively slowly. This may result in arcing and potential damage to or fusing of the contacts of the switch in which the bi-metallic components are used.

One known type of temperature regulator comprising a bi-metallic component is described in U.S. Pat. No. 3,110,789 ('789). This uses a magnet to overcome the aforementioned issues associated with the slow making and breaking of electrical contacts.

The displacement force from the bi-metallic component needs to be greater than the magnetic attraction force holding the contacts closed, thereby resulting in a sudden "snap" movement as the forces are overcome. This "snap" is relatively rapid with little opportunity for arcing or fusing to occur. However, the regulator of '789 is a reasonably complex arrangement and is still prone to all the shortcomings of using bi-metallic components discussed above.

An alternative approach is disclosed in U.S. Pat. No. 5,696,479. This patent describes the use of an over centre spring to provide the "snap" action required to achieve fast connection or disconnection of the contacts. As above however it still relies on the use of a bi-metallic component with their attendant disadvantages.

Another method of temperature control is to use an electronic circuit to monitor the temperature of a probe and drive a relay. This method however is often not suitable for use in high-temperature environments (or low-temperature), is more expensive, and in many cases the relay needs to be physically large (and often expensive) in order to switch high-currents at high-voltages.

It is an object of the present invention to address the foregoing problems or at least to provide the public with a useful choice.

All references, including any patents or patent applications cited in this specification are hereby incorporated in their entirety by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Further aspects and advantages of the present invention will become apparent from the ensuing description which is given by way of example only.

DISCLOSURE OF THE INVENTION

According to one aspect of the present invention, there is provided a switch device that includes or otherwise comprises:

a first arm;

a second arm;

a biasing means, structured and/or arranged to bias the first arm away from the second arm;

a first magnetic member provided to the first arm; and a second magnetic member provided to the second arm, wherein the first magnetic member and the second magnetic member are structured and/or arranged to provide an attraction force between the first and second arm.

According to another aspect of the present invention, there is provided a method of manufacturing a switch device, wherein the switch device includes or otherwise comprises:

a first arm;

a second arm;

a biasing means, structured and/or arranged to bias the first arm away from the second arm;

a first magnetic member provided to the first arm; and a second magnetic member provided to the second arm, wherein the first magnetic member and the second magnetic member are structured and/or arranged to provide an attraction force between the first and second arm.

The switch device of the present invention includes an arrangement of a pair of arms that co-operate with a biasing means in combination with magnetic components provided on each of the arms.

In simple terms, should the force of the biasing means be greater than the magnetic attraction force of the respective magnetic components, then the arms will be separated. If the magnetic attraction force exceeds the biasing force then the arms will be closed. In this way the switch has two potential states; a first with the arms open and a second with the arms closed. The opening/closing of the arms may be configured to enable an electronic circuit or provide further means of mechanical activation substantially as described herein.

It should be understood that the term "magnetic", as used throughout this specification, refers to either exhibiting the properties of a magnet or being capable of being attracted to a magnet. That is, the term encompasses both magnetised materials (including permanent and temporary magnets) that produce a magnetic field as well as materials that are attracted to such magnetised materials, typically ferromagnetic or ferrimagnetic materials such as iron and steel.

It will further be understood that for two magnetic members to be capable of magnetic attraction, one or both of the magnetic members needs to be magnetised. In the case of the present invention, either magnetic member of the switch device may be magnetised.

It is also appreciated that the term "provided" should be interpreted in its broadest sense meaning:

a separate component attached to the arm; or the arm itself includes the magnetic member; or the arm is a magnetic member.

The term "to bias the first arm away from the second arm" should be taken to mean that the biasing force is configured to provide a force to encourage at least partial separation of the arms from one another. The separation may either be a space between two substantially parallel arms, or a space between at least one portion of the first arm and the second arm. For example, the first arm and second arm may be connected at a first end and the biasing means may be structured to provide a separation force configured to encourage separation of another portion of the first and second arms away from one another.

The term "attraction force" is a well understood phenomenon between magnetic devices, and in the context of the present disclosure it should be taken to mean a force configured to encourage at least a portion of the first arm towards at least a portion of the second arm.

The term "arm" should not be seen as limiting on the invention. It should be taken to mean a member capable of supporting the associated elements. It may be a rod, a plate, a sheet or any number of complex three-dimensional shapes.

Preferably the first arm includes or otherwise comprises a first electrical contact.

Preferably the second arm includes or otherwise comprises a second electrical contact.

Preferably the first and second electrical contacts are configured to connect an electrical circuit when closed, and disconnect said circuit when opened.

Preferably the first magnetic member includes or otherwise comprises a permanent magnet.

Preferably the second magnetic member includes or otherwise comprises a ferromagnetic material.

Preferably the ferromagnetic material includes or otherwise comprises an alloy of nickel and iron.

Preferably the ferromagnetic material includes or otherwise comprises approximately 36% nickel and approximately 64% iron. However, it is appreciated that the material may further comprise small amounts of other materials such as chromium, manganese, silicon, carbon, aluminium, zirconium, titanium, phosphorous and sulphur and so forth.

Preferably the biasing means is provided by a leaf spring.

Preferably the switch further includes or otherwise comprises a first adjustment device configured to set or otherwise adjust the force provided by the biasing means.

Preferably the first adjustment device is a cam.

Preferably the cam is configured so that rotation of the cam varies the force applied by the biasing means.

Preferably the biasing means further includes or otherwise comprises a second adjustment device to allow further adjustment of the force provided by the biasing means at any given cam position.

Preferably the second adjustment device includes or otherwise comprises an external thread configured to engage with a complementary internal thread in the biasing means.

Preferably the second adjustment device further includes or otherwise comprises a keyed internal cavity to facilitate rotation of the second adjustment device.

Preferably the second adjustment device includes or otherwise comprises a surface adapted to contact the first adjustment device.

Preferably the second arm includes or otherwise comprises a an adjusting mechanism, configured to enable adjustment of the relative separation between the first and the second arms when the force applied by the biasing means is greater than the force applied between the first and second magnetic members.

Preferably the adjusting mechanism includes or otherwise comprises an external thread configured to engage with a complementary internal thread in the second arm.

Preferably the adjusting mechanism further includes or otherwise comprises a keyed internal cavity to facilitate rotation of the adjusting mechanism.

Preferably the adjusting mechanism device includes or otherwise comprises a surface adapted to contact the first adjustment device.

Preferably, when the present invention is in operation, the first arm moves towards or away from the second arm.

Preferably the first arm includes or otherwise comprises a first region which is configured to move relative to another region of the first arm and to the second arm.

Preferably, when the present invention is in operation, the second arm is substantially stationary.

Preferably the movement of the first arm is sufficient to connect or disconnect the first electrical contact to/from the second electrical contact.

Preferably the second magnetic member, and/or the second arm includes or otherwise comprises lateral side members configured to increase the attraction force between the first and second arms.

According to a further aspect of the present invention there is provided a switch device substantially as described above, wherein the switch device further includes or otherwise comprises:

a heating device in communication with the second magnetic member, wherein, in-use, the heating device modifies the temperature of the second magnetic member to modify the magnetic permeability of the second magnetic member and therefore adjust the attraction force between the first and second arm.

It is appreciated that the purpose of a heating device is to increase the temperature of a heating element or similar structure. The term "modifies the temperature" should generally be interpreted as heating the second magnetic member. However, it should be appreciated that when the heater is disabled, this may result in a cooling of the second magnetic member towards the ambient temperature.

Magnetic permeability should be understood to mean the ability of a material to support the formation of a magnetic field within itself. For example, materials containing iron typically comprise a higher permeability as they are support the formation of a magnetic field. Conversely wood has a very low permeability as it is very difficult to form a magnetic field within wood. It is also appreciated that the term "magnetic susceptibility" could be used almost interchangeably with "magnetic permeability" as they are closely related. However, for sake of clarity and consistency, the present disclosure uses the term "magnetic permeability". Where the term permeability is used alone, it should be taken to mean magnetic permeability.

It is also appreciated that the second magnetic member may increase or decrease in magnetic permeability as it is heated. It may even increase over a given range of temperatures, and decrease over another temperature range.

Preferably the heating device is a ceramic heater.

Preferably the heating device is attached to the second magnetic member.

Preferably the heating device is attached to the second magnetic member on the opposite side to the location of the first magnetic member.

Preferably the heating device is connected either in series with the electrical contacts or in parallel with a load attached to the switch, such that closing the electrical contacts enables the heating device.

According to a further aspect of the present invention there is provided a switch device substantially as described above, wherein the switch device further includes or otherwise comprises:

a shield device, wherein the shield device is structured and/or arranged to at least partially reduce the strength of the magnetic field acting on the second magnetic member from the first magnetic member.

Preferably the shield device includes or otherwise comprises ferromagnetic material.

Preferably the shield device includes or otherwise comprises an alloy of nickel and iron.

Preferably the shield device includes or otherwise comprises approximately 36% nickel and approximately 64% iron. However, it should be appreciated that the shield device may further include or otherwise comprise small amounts of other materials such as chromium, manganese, silicon, carbon, aluminium, zirconium, titanium, phosphorous and sulphur etc.

Preferably the shield device reduces its magnetic permeability when heated.

According to a further aspect of the present invention there is provided a switch device, substantially as described above, including or otherwise comprising both the heating device and shield device substantially as described above.

According to a yet further aspect there is provided a temperature regulation device comprising the switch device substantially as described above.

Preferably the temperature regulation device includes a temperature control means.

Preferably the temperature control means modifies the force applied by the biasing means.

Preferably the temperature control means is a cam.

Preferably, when the invention is in operation, the temperature control means is adjusted to reduce the force applied by the biasing means such that the attraction force between the first magnetic member and the second magnetic member exceed the biasing force resulting in a closing of the electrical contacts.

Preferably the closing of the electrical contacts enables a heating device which acts to raise the temperature of at least one of the first or second magnetic members, thereby reducing its magnetic permeability and the resulting attraction force between the magnetic members.

Preferably the reduced attraction force results in a biasing force which is greater than the magnetic attraction force resulting in a disconnection of the electrical contacts, subsequent cooling of the first and or second magnetic members, and a cyclic repeating of the heating/cooling cycle.

According to a yet further aspect there is a switch comprising a combination of features from any one of the above aspects.

It is envisaged that the present invention will find particular application in temperature regulating circuits used in appliances such as stoves and refrigerators. However, a person skilled in the art would appreciate that it could be used for any number of applications, particularly those which use bi-metallic components.

For example, another practical application for the present invention is in circuit breakers, where current flow in the circuit breaker may heat a second magnetic member reducing the attraction to a first magnetic member and breaking the electrical circuit. It would be equally applicable in an automatically resetting circuit breaker, or one which requires manual activation, such as those included on power boards and surge protectors.

One of the key advantages provided by the present invention is the at least partial removal of bi-metallic components. It is envisaged that the removal or at least minimising of bi-metallic components may result in cost savings for the manufacturer and/or purchaser.

In addition the arrangement described herein may be less complicated than existing temperature regulation devices, therefore providing potential manufacturing and reliability improvements.

A number of other advantages will be apparent to those skilled in the art but at the very least the present invention provides the public with a useful choice.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
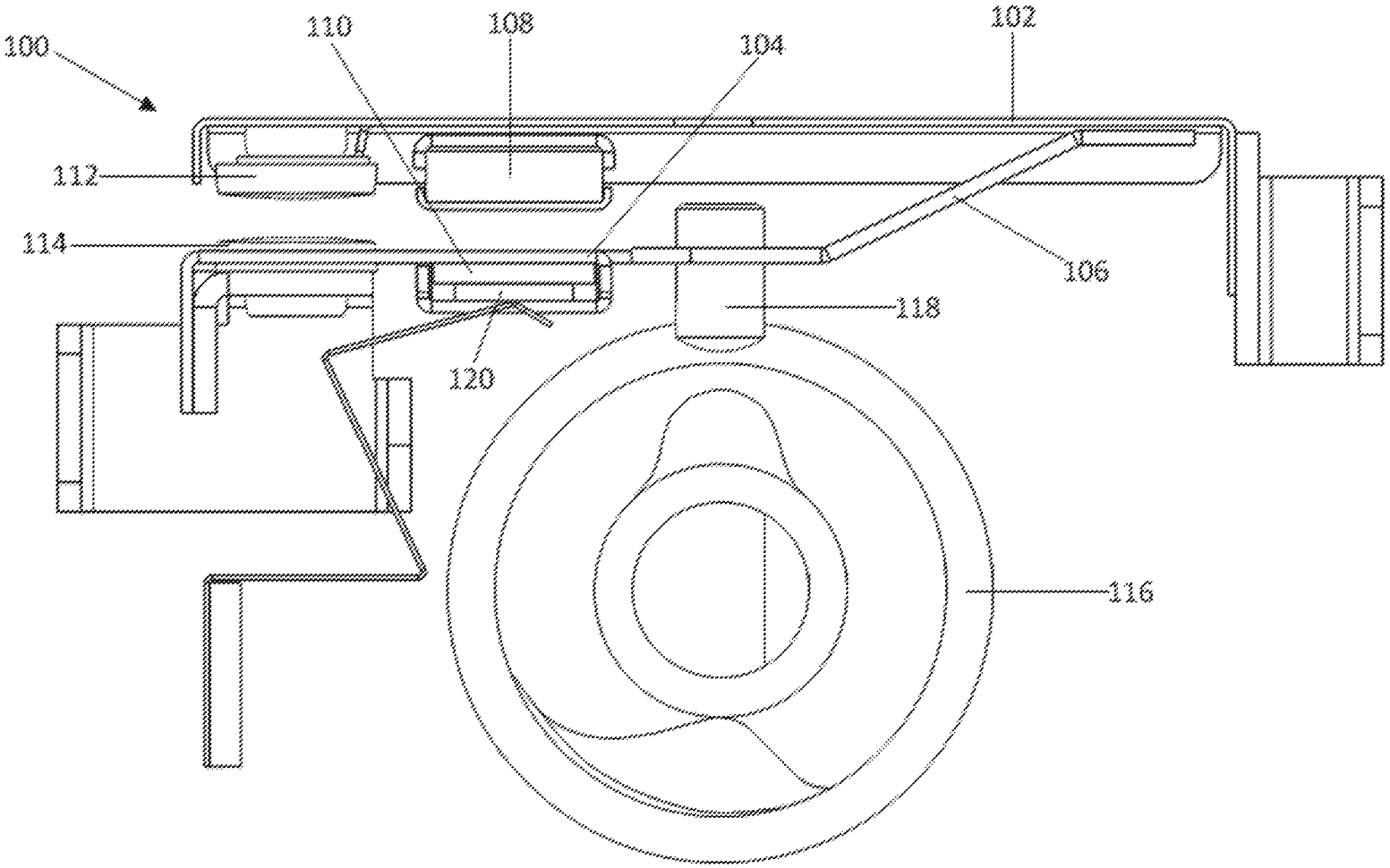
FIG. 1 shows a side perspective view of the components of a switch of the present invention.

One embodiment of the switch of the present invention is shown in FIG. 1. The switch (100) comprises a first arm (102) and a second arm (104), which are biased apart from one another by the biasing means (106).

In the embodiment shown, the first magnetic member (108) is provided to the first arm (102), while the second magnetic member (110) is provided to the second arm (104). Also shown is a first electrical contact (112) provided to the first arm, and a second electrical contact (114) provided to the second arm.

The designation of the first arm (102) and second arm (104) is somewhat arbitrary, in that either arm may possess the corresponding features of the other. Nevertheless, for sake of clarity the following discussion is provided with the assumption that the first arm (102) comprises the first magnetic member, and the second arm (104) comprises the second magnetic member.

In its simplest form, if the attraction force exerted by the first magnetic member (108) onto the second magnetic member (110) is greater than the force provided by the biasing means (106) which biases the arms apart, then the switch will close an and an electrical connection will be formed between the first electrical contact (112) and the second electrical contact (114).

Preferably the second arm (104) is substantially fixed, although its position relative to the first arm (102) may be adjusted to change the effective attraction force exerted on the second magnetic member (110) from the first magnetic member (108). It is appreciated however, that the first arm (102) may be fixed and the second arm (104) may move, or alternatively both the first and second arms may move.

Preferably the first arm (102) moves between a first position where the first electrical contact (112) and second electrical contact (114) are closed and a second position wherein the contacts are open. Although not shown here, in the preferred embodiment this arm may also comprise a switching blade as described in co-pending New Zealand Patent Application No. 732824 herein incorporated in its entirety by reference.

This switching blade configuration allows the first arm (102) to move away from the second arm (104), while the contacts (112, 114) remain connected. Then as the first arm (102) reaches a sufficient separation the contacts (112, 114) are separated rapidly breaking the flow of current.

Similarly, the attraction force between the first magnetic member (108) and the second magnetic member (110) of the present invention allows for a rapid connection of the electrical contacts (112, 114). This rapid connection minimises the amount of time in which hot-spots are likely to form due to the increased contact resistance associated with contacts (112, 114) being in light or partial contact with each other.

As shown in FIG. 1, the electrical contacts (112, 114) are provided to the first and second arms (102, 104). However, it is appreciated that the electrical contacts may be provided by separate members activated by the movement of the first and second arms (102, 104).

The electrical contacts (112, 114) are preferably made of a suitable conductive material such as copper or silver. However, it will be well known to those skilled in the art that other materials may be used, particularly in cost sensitive applications.

It should also be appreciated that additional contacts may also be provided for the purpose of snubbing any arcs which may form during the opening or closing of the first and second electrical contacts.

In the preferred embodiment, the biasing means (106) is structured and or arranged substantially as shown FIG. 1. However, it should be appreciated that the biasing means could be a spring, (for example, compression, torsion, leaf and so forth) a resiliently deformable material, (such as rubber or similar elastomeric member) or formed as a region of the first arm (102) itself, for example, as a living hinge.

In addition, and although not illustrated here, the biasing means (106) may be constructed using a plurality of biasing members, the plurality of biasing members being interconnected so that they share a common adjustment device. Alternatively, each biasing member may have a separate adjustment device.

In the illustrated embodiment, the first magnetic member (108) is a permanent magnet selected for the intended switch application. It is important to select a magnet with a Curie temperature which exceeds the operating temperature of the switch. The Curie temperature will be well known by those skilled in the art to be the temperature at which a material begins to lose its permanent magnetic properties.

Preferably the magnet is a samarium-cobalt (SmCo) magnet. This type of magnet advantageously has a high temperature rating; alternatively, the magnet may be made at least partially from neodymium or other magnetic materials as would be known to those skilled in the art.

Returning now to FIG. 1, although the first magnetic member (108) is shown as being on the first arm (102), it may be located on the second arm (104). A person skilled in the art would appreciate that the purpose of the first magnetic member (108) in conjunction with the second magnetic member (110) is to provide an attraction force between the first and second arms (102, 104). As such the positioning described herein and illustrated in the accompanying drawings is provided by way of example only and should not be considered limiting on the invention.

Figure 2A:
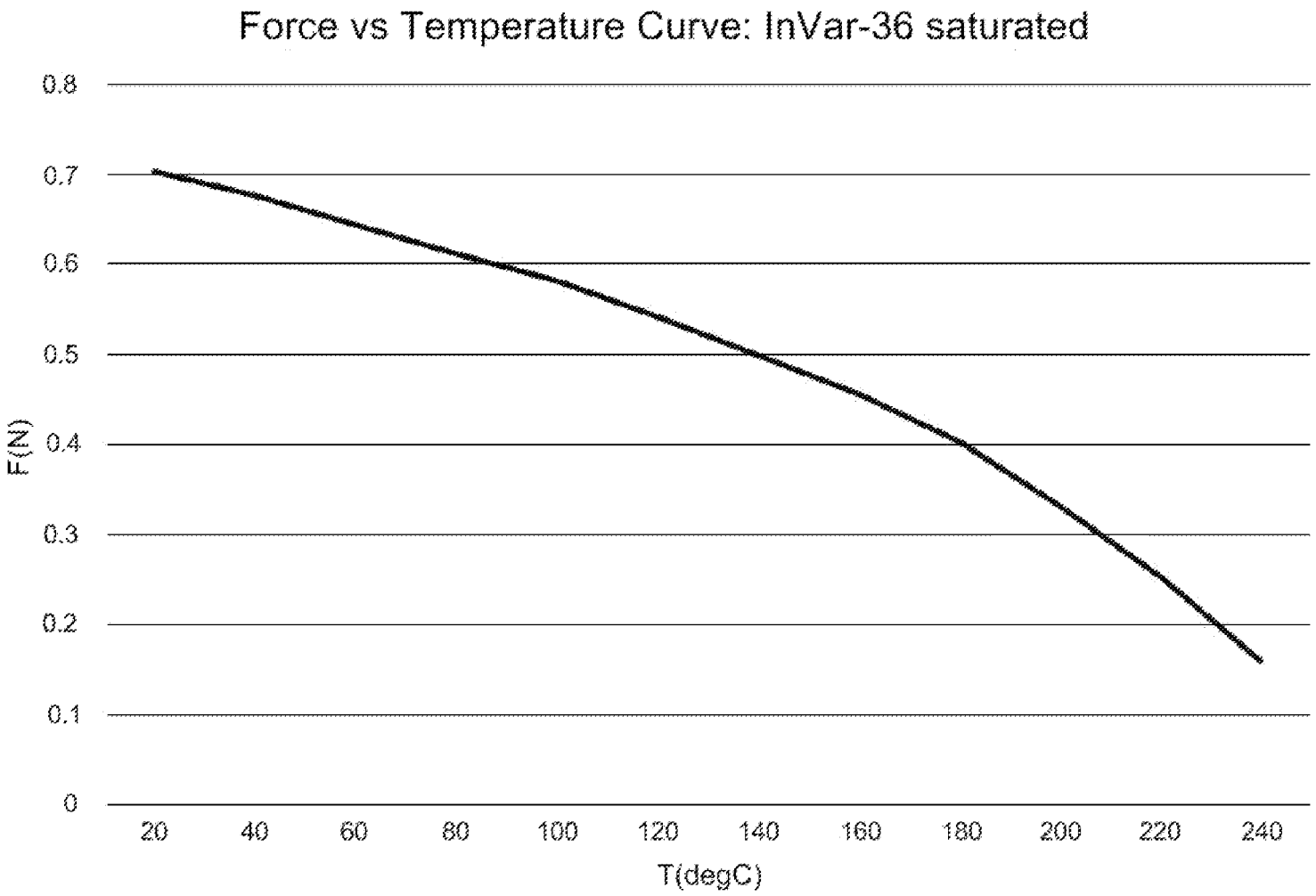
FIG. 2*a* shows an example of how the attraction force provided between the first magnetic member and the second magnetic member (Invar 36) may vary over temperature when the second magnetic member is saturated or near saturation.

The second magnetic member (110) is preferably a nickel-iron alloy. Preferably the nickel-iron alloy comprises around 36% nickel and 64% iron. This particular alloy (known as Invar 36) has a low coefficient of thermal expansion, and importantly a magnetic permeability which, when saturated or near saturation is known to reduce as the temperature increases. An example of this behaviour is illustrated in the Force vs Temperature curve of FIG. 2*a*. The Force axis relates to the magnetic attraction force between the first and second magnetic members, while the Temperature axis relates to the temperature of the second magnetic member (Invar 36).

Figure 2B:
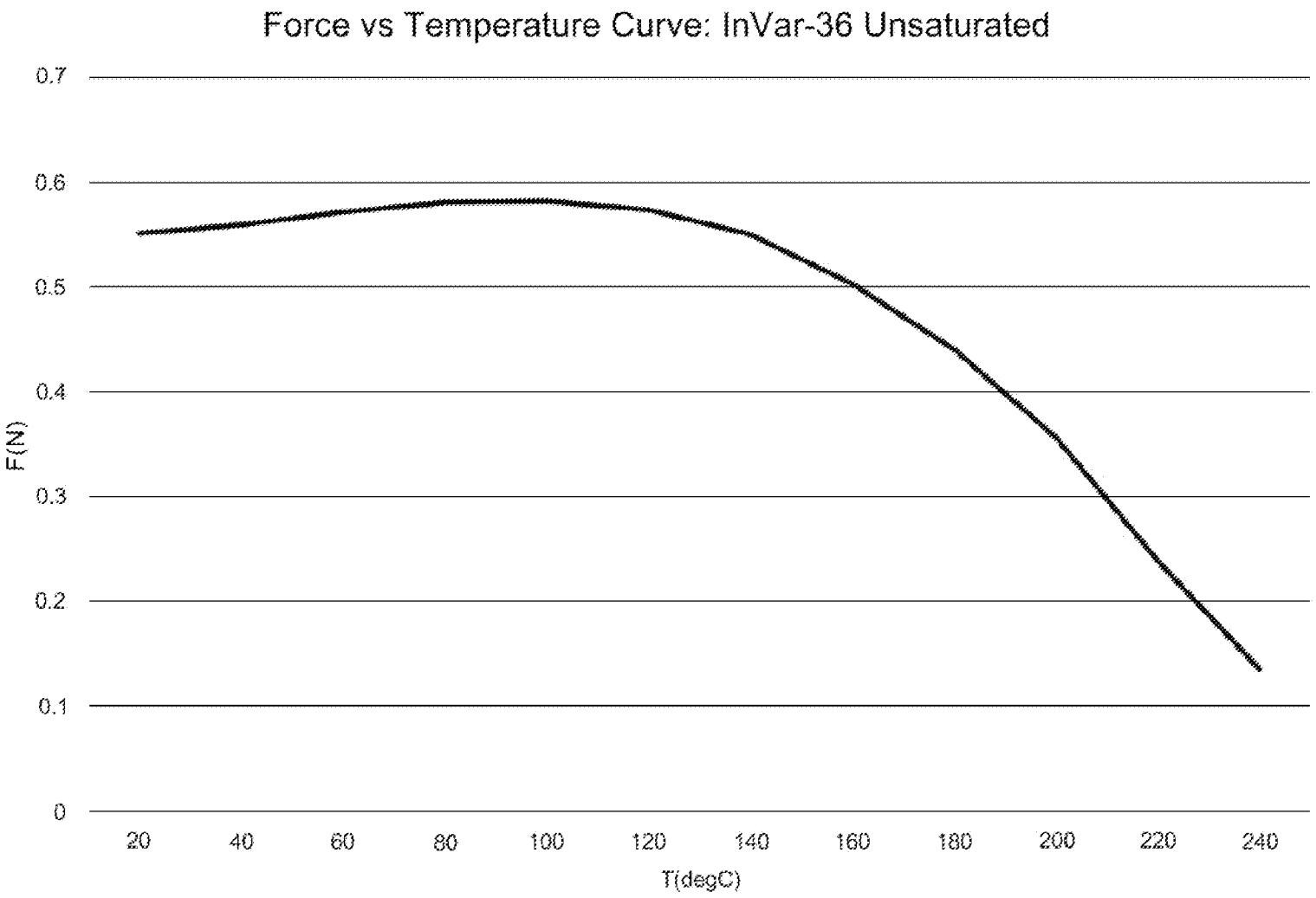
FIG. 2*b* shows an example of how the attraction force provided between the first magnetic member and the second magnetic member (Invar 36) may vary over temperature when the second magnetic member is not saturated or near saturation.

FIG. 2*b* provides an example of a Force vs Temperature curve for the magnetic attraction force when the invar is not saturated or near saturation. Note that there is a lower variation in attraction force between 20 to 140 degrees Celsius. It is therefore preferable for the present invention to operate with the second magnetic member (110) (Invar 36) at or near saturation.

Saturation in a magnetic sense is a term well known by those skilled in the art as the state at which an increase in applied magnetic field does not further increase the magnetisation of the material. It is also to be understood that this effect can also be observed under other conditions as known in the art, such as when the material is heated towards its Curie temperature, although the reduction in permeability is more sudden at this point.

The present invention provides a switch which operates without relying on the Curie temperature. It should also be appreciated that while Invar 36 is desirable for use in the present invention, it is not essential, and other nickel/iron alloys such as Invar 37 (substantially 37% nickel and 63% iron) may be used. Alternatively, the second magnetic member may use any alloy or material which exhibits desirable temperature/permeability characteristics, when saturated or otherwise.

Alternatively, the second magnetic member (110) may have a magnetic permeability which increases as the temperature increases, or a complex relationship between temperature and magnetic permeability. For a selected temperature range, an otherwise complex relationship between temperature and magnetic permeability may be suitable for use in a switch of the present invention.

By way of example, in a cooling device such as a freezer, it may be desirable to replace the heating device of the present invention with a cooling device. The cooling device may be provided by thermal conduction from the freezer, or alternatively the present invention may be provided within the freezer for example as a thermostat. Pairing this cooling device with a second magnetic member which has an increasing magnetic permeability as the temperature increases (across the relevant temperature range) would result in a stronger attraction force between the first and second arms as the freezer warms up, thereby closing the contacts and causing the cooling circuit to start hence regulating temperature.

It is also to be appreciated that the second magnetic member may be a permanent magnet. In this configuration, the magnets are positioned such that the north pole of the first magnetic member faces towards the south pole of the second magnetic member (or vice versa). This configuration advantageously provides a greater attraction force when the magnets are spaced apart and can therefore accommodate a greater clearance between the first arm and the second arm.

Referring to FIG. 1 once more, a first adjustment device (116) is provided in the form of a cam. A second adjustment device (118) is also provided for fine adjustment of the force provided by the biasing means (106). This second adjustment device (118) can be adjusted to compensate for any manufacturing variation in the biasing means (106), first magnetic member (108) or second magnetic member (110). The second adjustment device (118) is also configured to transfer the force from the first adjustment device (116) to the biasing means (106).

Adjustment of the second adjustment device (118) is ideally provided by a threaded connection with the biasing means (106). An optional keyed internal aperture for may provide the adjustment means. However, it is appreciated that the second adjustment device (118) could consist of other configurations as will be apparent to a person skilled in the art.

In use, rotation of the first adjustment device (116) modifies the force exerted by the biasing means (106) to separate the first arm (102) from the second arm (104). It does this by varying the radial distance between the centre of the first adjustment device (116) and the surface contacted by the second adjustment device (116).

For example, when used as a heater the first adjustment device (116) may be rotated to a region with a low radial distance, therefore reducing the force provided by the biasing means (106), tending the magnetic force to be greater than the biasing force and closing the contacts. This would correspond to a "high" temperature on the heater. Similarly, the first adjustment device (116) comprises an area of high radial distance, which would similarly correspond to a low temperature.

It would also be appreciated that the first adjustment device (116) may, in at least one orientation, cause the biasing means (106) to exert a force in excess of the maximum attraction force capable between the first magnetic member (108) and the second magnetic member (110), thereby safely disabling the switch. Similarly the first adjustment device (116) may, in at least one orientation, cause the biasing means (106) to remove or substantially reduce the biasing force so that the contacts will not open even with minimal/zero attraction force.

In the temperature regulating embodiment of the present invention, preferably the first adjustment device (116) is a cam as illustrated in the accompanying figures. Alternatively, adjustment could be provided by other means such as a slide mechanism, an actuator or an electronic control circuit. Such arrangements should be readily implemented by a person skilled in the art.

While the invention in this form works as a switch, it is an aspect of the present invention to provide an output suitable for temperature regulation. In order to provide this, a heating device (120) is provided to the second magnetic member (110). It is appreciated however, that the heating device (120) may be provided to the first magnetic member (108), the second magnetic member (110), the shield (802) or any combination of these. The heating device (120) is preferably provided to the second arm (104) as the electrical connection to the heating device (120) need not account for the range of movement present in the first arm (102). Methods of providing an electrical connection to a heating device (120) will be well known by those skilled in the art.

The heating device (120) is preferably a ceramic heater which is connected either in series with the first (112) and second (114) electrical contacts or in parallel with any electrical load. Alternatively, the heating device (120) may comprise a resistive heater and/or be printed directly onto the second magnetic member (110).

When the circuit is closed and the electrical contacts (112, 114) contact one another, current starts to flow. This current raises the temperature of the heating device (120) and consequently the second magnetic member (110). As such the magnetic permeability of the second magnetic member (110) starts to fall. The reduction in magnetic permeability reduces the attraction force provided between the first magnetic member (108) and the second magnetic member (110).

When this attraction force is lower than the force provided by the biasing means (106), the first arm (102) and second arm (104) are moved apart disconnecting the electronic circuit. With the heating device (120) now disconnected, the second magnetic member (110) starts to cool, increasing its permeability once again.

When the attraction force between the second magnetic member (110) and the first magnetic member (108) exceeds the biasing force provided by the biasing means (106) the circuit is closed and the cycle repeats. In this way, an effective pulse-width-modulated (PWM) output is achieved. The set point for this output is provided by the position of the first adjustment device (116), and therefore the biasing force provided by the biasing means (106). It is appreciated that the PWM output would be suitable in many applications including temperature regulation.

A high biasing force, biasing the arms apart can only be overcome by a correspondingly high magnetic attraction force (cool second magnetic member (110), short switch on-time, long switch off-time), and correspondingly a weak biasing force will only be able to overcome a weak magnetic force (hot second magnetic member (110), long switch on-time, short switch off-time).

Figure 3A:
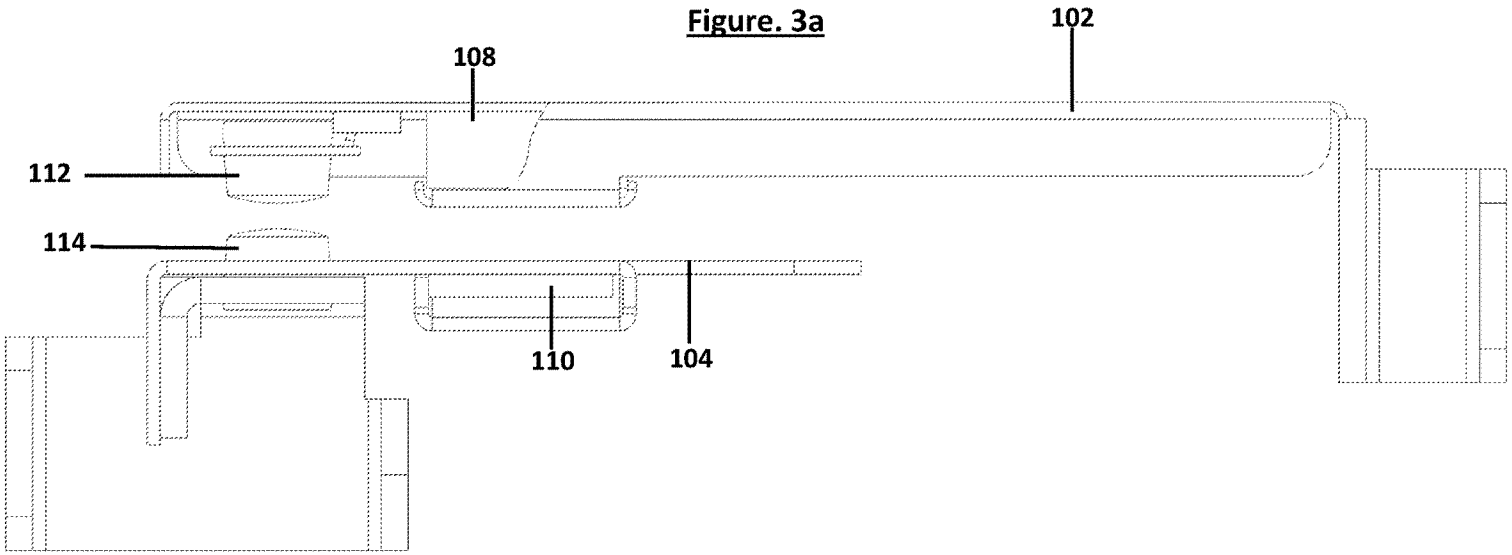
FIG. 3*a* shows a side view of the switch, in an operative state where the contacts are open.

FIG. 3*a* shows a simplified view of the switch assembly of the present invention wherein the first arm (102) and second arm (104) are in a first position wherein the contacts (112,114) are separated and the circuit is open. In this position, the force applied by the biasing means (not illustrated) exceeds the magnetic attraction force between the first magnetic member (108) and second magnetic member (110).

Figure 3B:
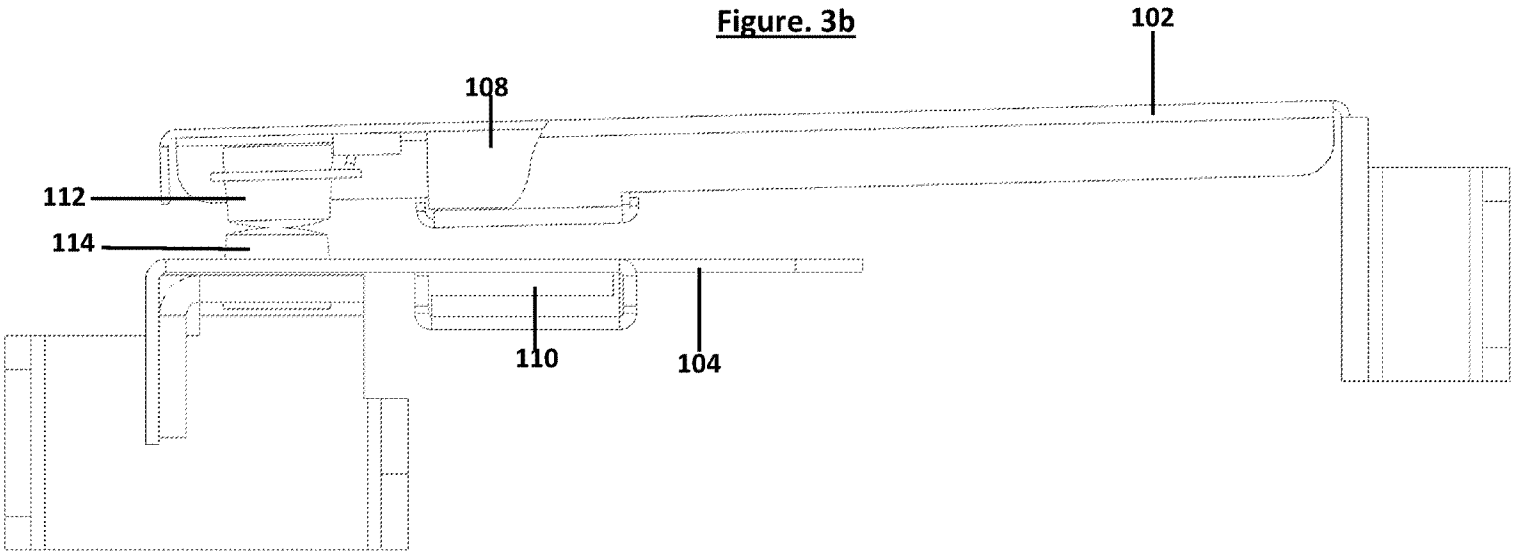
FIG. 3*b* shows a side view of the switch, in an operative state where the contacts are closed.

Conversely FIG. 3*b* shows the first arm (102) in a second position wherein the contacts (112, 114) are in contact with one another and the circuit is closed. In this configuration, the force applied by the biasing means (not illustrated) is less than the magnetic attraction force between the first magnetic member (108) and second magnetic member (110). It should be appreciated that once the electrical contacts have closed, as shown in FIG. 3*b*, the first arm may be further displaced to position the first and second magnetic members closer than shown. This may be accommodated by flexibility in the first arm, by using a switching blade as described in co-pending New Zealand Patent Application No. 732824 herein incorporated in its entirety by reference, or by any other means apparent to those skilled in the art.

Figure 4:
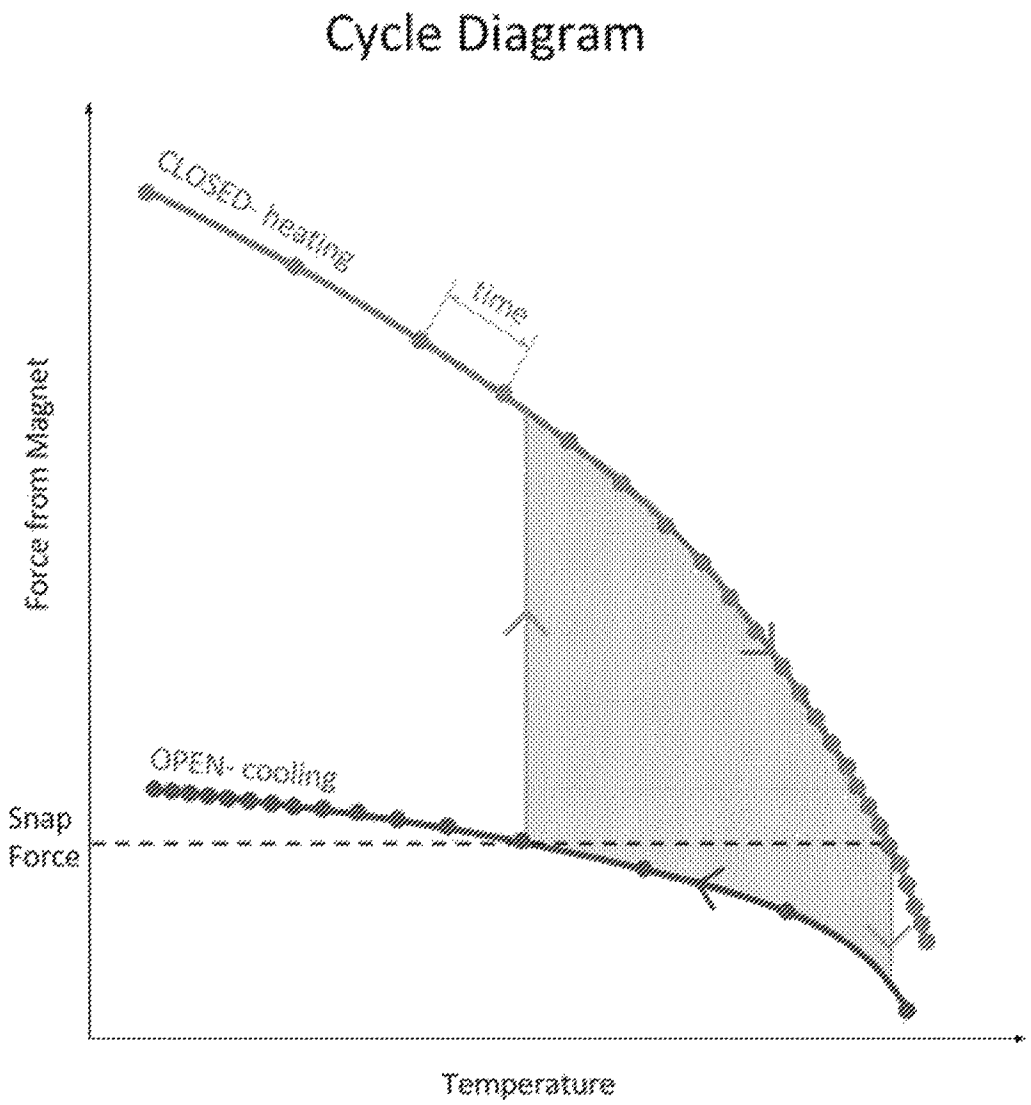
FIG. 4 shows a cycle diagram illustrating the operating principles of the switch in the present invention.

FIG. 4 is a cycle diagram which illustrates the hysteresis associated with transitioning between the open and closed states of the switch. Two force-temperature curves are provided, the curve marked "CLOSED-heating" shows the force versus temperature curve for when the contacts are closed, and the "OPEN-cooling" curve shows the temperature curve when the contacts are opened. The dashed line indicates the force at which the transitioning between the two states occurs.

When the arm is closed, the second magnetic member begins heating until the magnetic attraction force between the first magnetic member and second magnetic member drops below the dashed line marked "snap force". At this point the contacts open and second magnetic member starts cooling (following the "OPEN-cooling" curve). When the magnetic attraction force between the first and second magnetic members exceeds the "snap force" then the switch contacts close, and the diagram transitions back into the "CLOSED-heating" state and the cycle repeats.

The dots illustrated on the respective curves illustrates the time intervals associated with exponential heating and cooling as would be understood by those skilled in the art. The effective PWM duty cycle is a ratio of the time spent with the electrical contacts closed (heating the second magnetic member) and the time spent with the contacts open (second magnetic member cooling to the ambient temperature).

Figure 5:
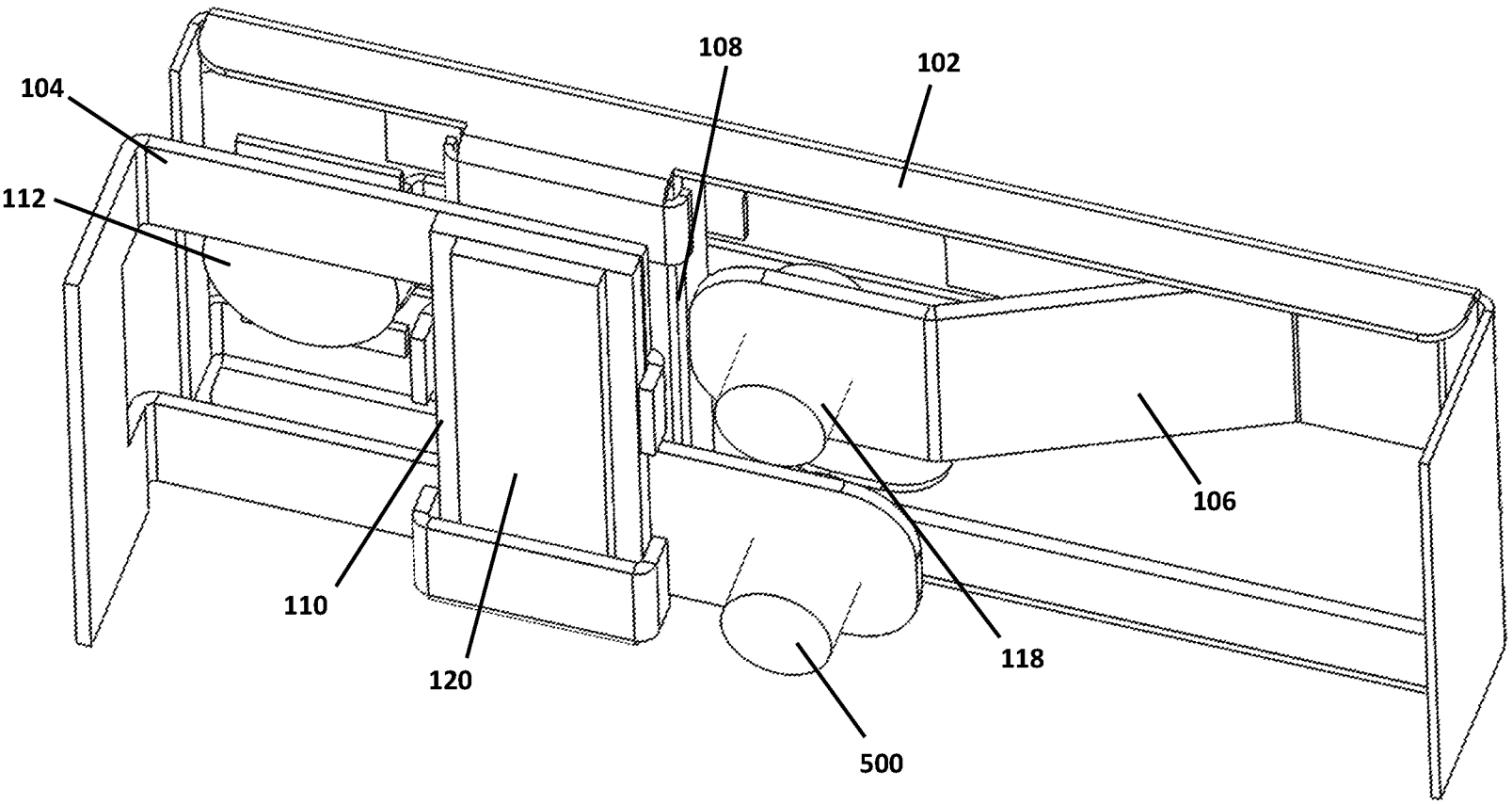
FIG. 5 shows a lower perspective view of the switch of the present invention.

FIG. 5 provides a lower perspective of the components of the switch of the present invention. From this perspective, it can be seen that an adjusting mechanism (500) is provided to the second arm (104). The adjusting mechanism may act upon the first adjustment member or cam (116), or alternatively may be provided to a fixed member attached to the body of the switch (not shown).

When acting upon the cam, it would be appreciated that adjustment of the bias is available when the user adjusts the cam. However the adjustment provided by rotation of the cam need not be the same as the adjustment provided to the second adjustment member (118) in that the adjusting mechanism (500) may act upon a separate region of the cam. It would also be appreciated that this separate region of the cam may have any cross sectional profile, including a substantially constant radial distance in which adjustment of the cam provides little or no adjustment to the second arm (104).

Figure 6:
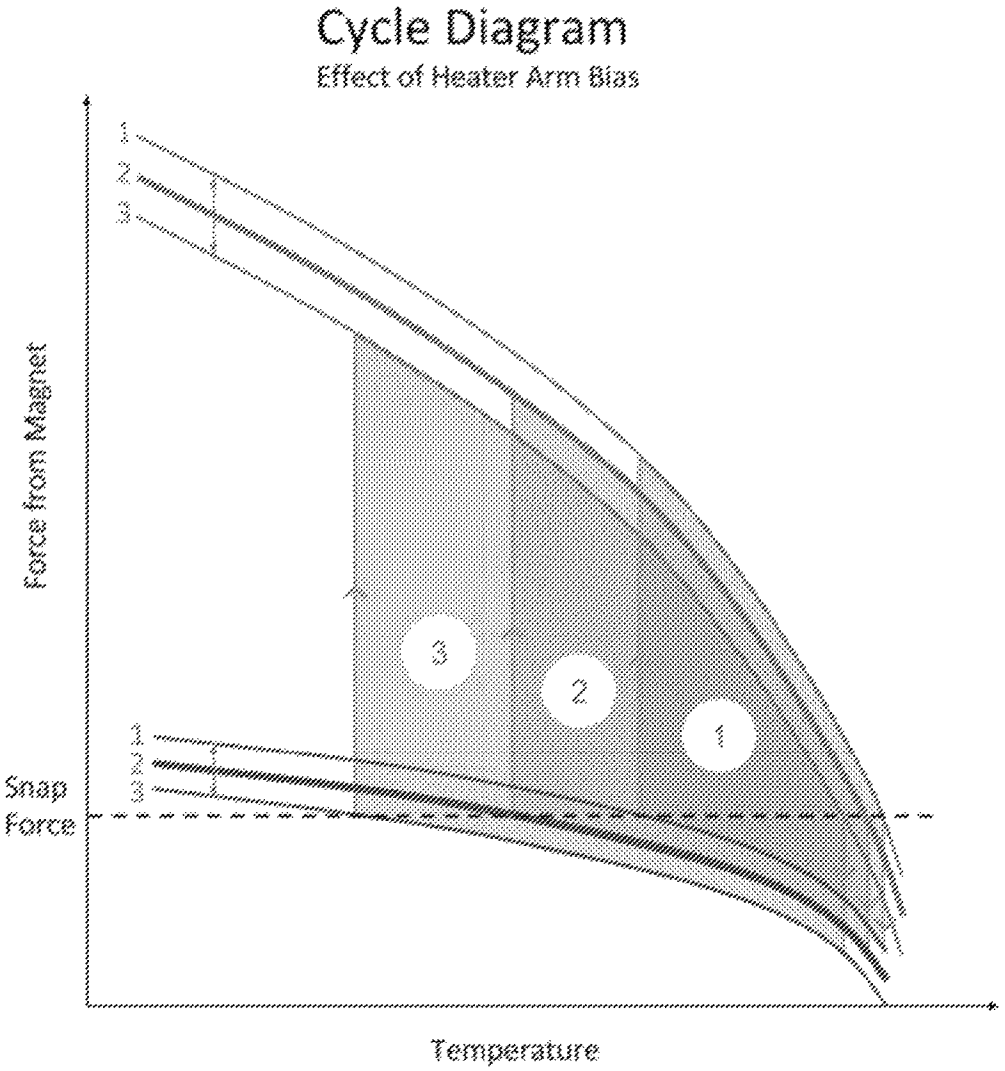
FIG. 6 shows a further cycle diagram illustrating the effect of the third adjustment member on the present invention.

This adjusting mechanism (500) biases the second arm (104) either towards or away from the first arm (102). As the heating device (120) is preferably provided to the second arm (104) this third adjustment device (500) may be referred to herein as a heater arm bias. This adjusting mechanism (500) is ideally threaded into the second arm (104) in a similar fashion as the second adjustment device (118) is provided to the biasing means (106). Adjustment of the adjusting mechanism (500) may also be via an internal keyed aperture (not shown). The effect of adjusting the adjusting mechanism (500) or heater arm bias is illustrated in FIG. 6.

Referring back to FIG. 2*a*, it will be appreciated that in order to achieve the force/temperature curve of Invar 36 shown in FIG. 2*a*, the Invar needs to be close to saturation. If the Invar is not at or near saturation then the force/temperature curve may be substantially different as shown in FIG. 2*b*. In addition, when the contacts are separated and the first magnetic member (108) is separated from the second magnetic member (110), the second magnetic member may transition from a near saturated state to a less or non-saturated state, changing the force/temperature characteristics.

To account for this the present invention provides a plurality of adjustment means (116, 118) and an adjusting mechanism (500) which allow the separation of the first magnetic member from the second magnetic member and the resulting biasing forces to be adjusted.

For example, the separation between the first magnetic member (108) and second magnetic member (110) may be reduced by adjusting the adjusting mechanism (500). In doing so the magnetic attraction force will increase. This can be accommodated for by adjusting the second adjustment device (118) in order to increase the biasing force to account for this.

In addition, the first adjustment device (116) may act upon the adjusting mechanism (500) to position the second magnetic member (110) closer to the first magnetic member (108), thereby increasing the PWM output duty cycle. However, for safety, the electrical clearance between the first and second electrical contacts (112, 114) needs to be kept within the appropriate limits defined by the switching voltage and the applicable safety standards in the country of use. To account for this the second adjustment device (118) may be adjusted to lower the biasing force to allow the same duty cycle to be achieved with a greater separation between the electrical contacts.

FIG. 6 follows the same principles illustrated in FIG. 4. However, provided are three positions in which the adjusting mechanism (500) or heater arm bias may be set. It will be appreciated that three positions are illustrated for sake of simplicity of the diagram, and the adjusting mechanism (500) may have adjustment positions provided outside of those illustrated, and at any point in between.

The region of the figure marked with a "2" relates to the adjusting mechanism (500) position 2 which is substantially equivalent to FIG. 4. It would be appreciated that adjusting the adjusting mechanism (500) (either by rotation of the adjusting mechanism or modification of the surface it acts upon) such that the second arm (104) is positioned closer to the first arm (102) would reduce the magnetic attraction force required to close the contacts (112, 114). This is represented by the region marked "1" in FIG. 6.

With reference to FIG. 6, it can be seen that region 1 requires a higher temperature before the "snap force" is reached. As this higher temperature relates to the heating of the second magnetic member (110), it also corresponds to a lower magnetic permeability. The lower magnetic attraction forces are required as the first and second magnetic member are now positioned closer together.

It can also be seen with reference to FIG. 4 that this would correspond to a switch duty cycle wherein the contacts are closed for a longer period of time than they are open. Conversely the region marked "3" relates to a position wherein the second arm (104) is biased further away from the first arm (102). In this position a higher magnetic permeability is required to increase the magnetic attraction force between the first (108) and second magnetic members (110). As previously discussed this occurs at a lower temperature and results in a switch duty cycle wherein the ratio of the contacts being closed to the contacts being open is more even.

Figure 7:
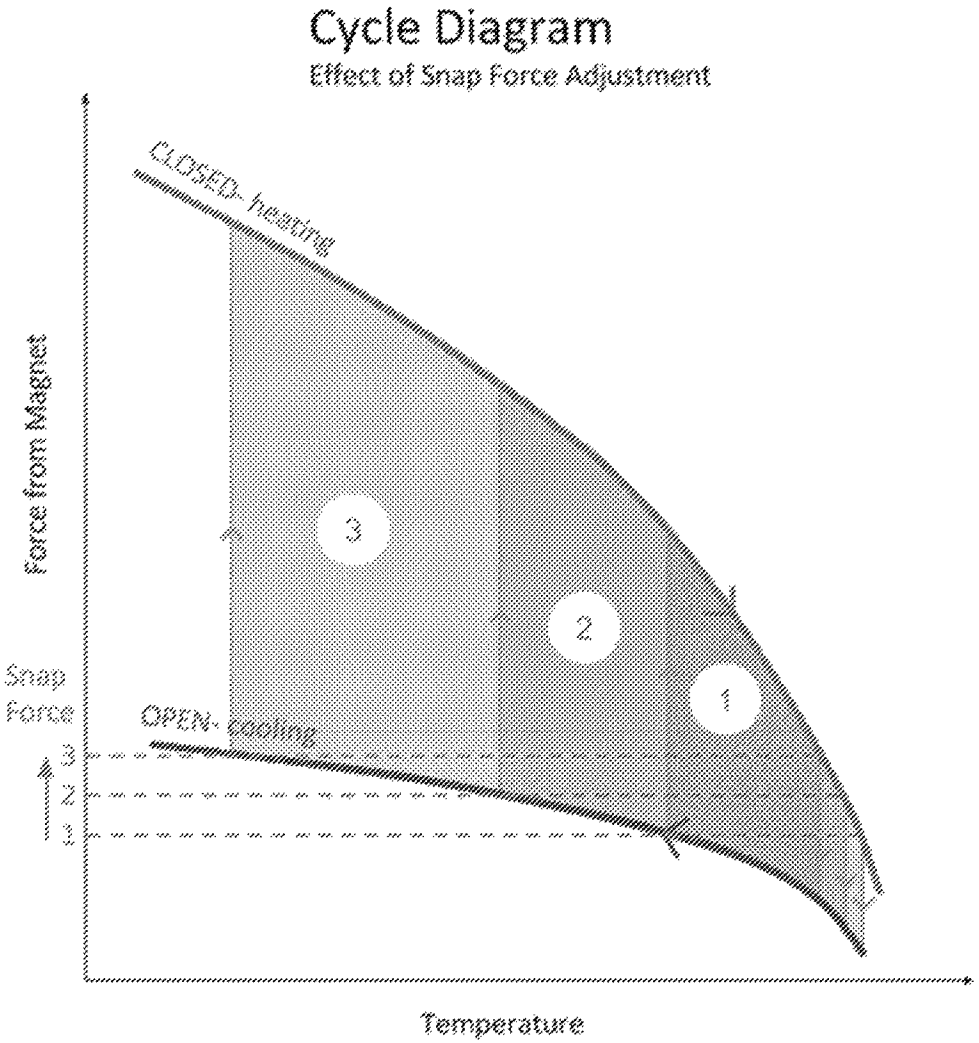
FIG. 7 shows a further cycle diagram illustrating the effect of the second adjustment member on the present invention.

FIG. 7 illustrates the effect of adjusting the second adjustment member (118) in order to charge the force applied by the biasing means (106) also referred to herein as the "snap force". Three regions are provided with a slight transparency to each. Each region corresponds to the area between the upper and lower curves defined by the point where the dashed Snap Force lines intersect the respective curves. Adjustment of the second adjustment member (Snap Force) is shown in three positions only for sake of simplicity, however it is to be appreciated that the second adjustment member (118) may comprise adjustment positions outside of those shown and the invention is not limited to discrete adjustment points but rather can be adjusted to any position between the minimum and the maximum.

As previously discussed, adjustment of the first adjustment member (116) is preferably configured to provide adjustment to the force applied by the biasing means (106) in a similar manner as illustrated in FIG. 7. However, for simplicity, FIG. 7 will now be discussed with reference to adjustment of the second adjustment member (116) only.

Adjustment of the second adjustment member (118) to raise the lower portion of the biasing means (106) towards the first arm (102) will increase the force applied by the biasing means (106). This will require a stronger attraction force between the first (108) and second (110) magnetic members in order for the contacts (112, 114) to close. As discussed the magnetic attraction force is greatest when the magnetic permeability of the second magnetic member (110) is highest (when the second magnetic member (110) is cool). This relates to the region marked "3" in FIG. 7. Conversely, the region marked "1" relates to a lower biasing force due to the second adjustment member (118) lowering the lower portion of the biasing means (106) away from the first arm (102). It can be seen from FIG. 7 that the second magnetic member (110) needs to be hotter before the contacts (112, 114) will separate corresponding to a lower magnetic permeability and a lower magnetic attraction force.

It will also be appreciated that the first (116) and second (118) adjustment members, and the adjusting mechanism (500), each work together to modify the characteristics of the switch as described herein, and the present invention has been described using these members in isolation for the sake of simplicity alone.

Figure 8:
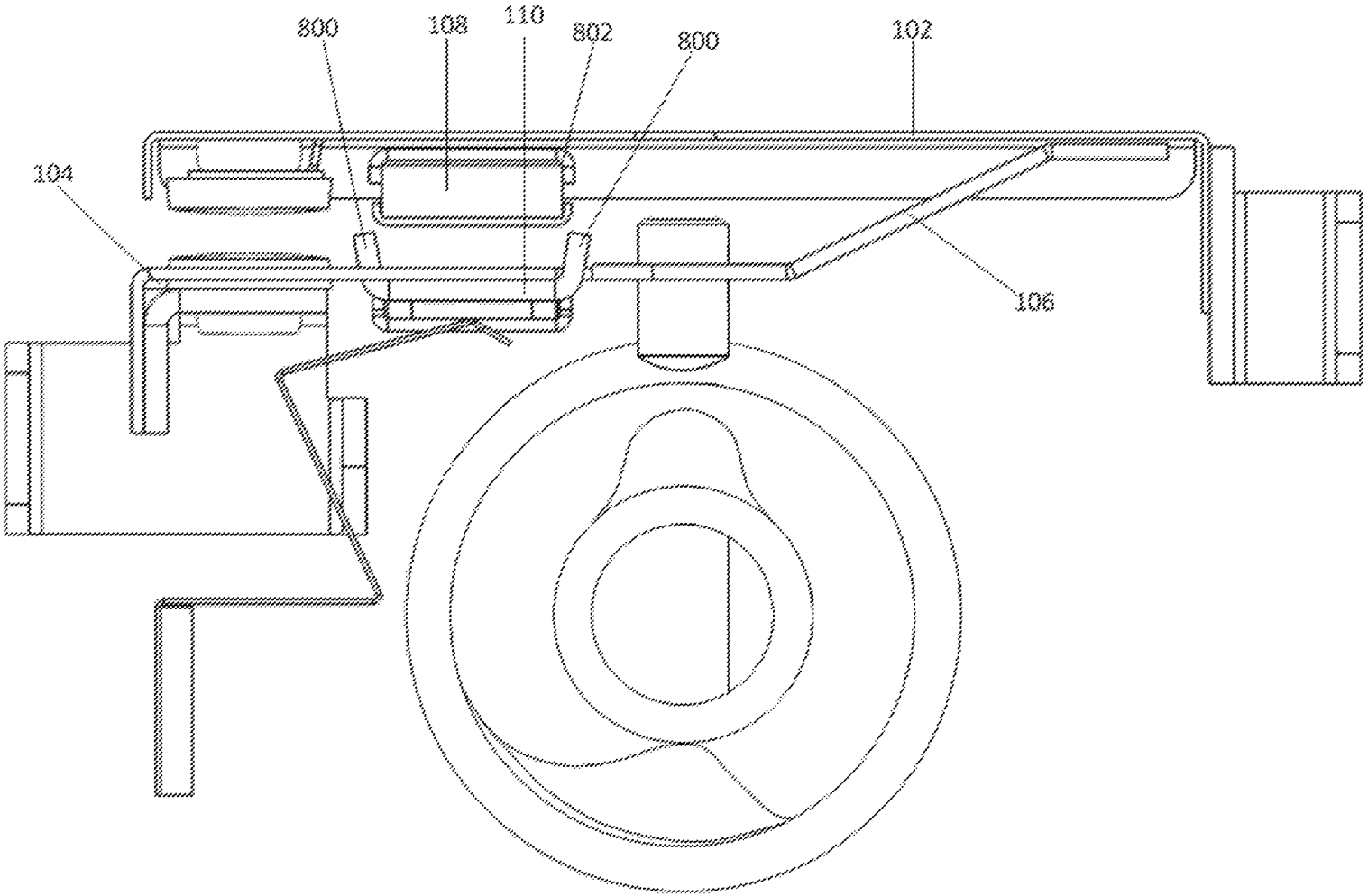
FIG. 8 shows an alternative embodiment of the invention wherein the coupling between the first and second magnetic members may be improved.

Further improvements to the invention can be found in FIG. 8, in which the coupling between the first magnetic member (108) and the second magnetic member (110) is improved. This improvement is achieved by providing lateral side members (800) to the second magnetic member (110) or second arm (104), effectively increasing the magnetic field coupling between the first magnetic member (108) and the second magnetic member (110) without needing to limit the travel of the first arm (102). A person skilled in the art would appreciate that method of improving this coupling may be achieved using alternative configurations, including but not limited to providing lateral side members to the first magnetic member (108) and/or the first arm (102).

Furthermore, although not illustrated in any figures, it would be appreciated that the attraction force between the first (102) and second (104) arms may be increased by positioning the first magnetic member (108) and the second magnetic member (110) closer together, for example on the inside edges of the respective arms.

It Is a further aspect of the present invention to provide a degree of ambient temperature compensation without the need to use bi-metallic components. Ambient temperature compensation is desirable as changes in the ambient temperature may heat or cool the second magnetic member (110) independently of the heating device (120) resulting in a different output or temperature than desired.

To account for this, the present invention introduces a shield device (802) as shown in FIG. 8. This shield device (802) is preferably constructed from the same material as the second magnetic member (110), and is arranged to at least partially reduce the field strength of the first magnetic member (108) acting upon the second magnetic member (110). The reduction in the field strength is a function of the magnetic permeability of the shield device (802), a material with a lower magnetic permeability has less influence on the magnetic field.

In use, ambient temperature changes within the switch cause temperature variations in the second magnetic member (110) and the shield device (802). An increase in temperature of the second magnetic member (110) results in a lower magnetic permeability which in turn reduces the attraction force between the first and second magnetic members (108, 110). However, as the temperature of the shield device (802) also increases, its permeability drops, reducing the shielding effect of the shield (802). This reduction in shielding effect at least partially compensates for the reduction in attraction force between the first and second magnetic members (108, 110), providing a measure of ambient temperature compensation.

The structure and positioning of the shield device (802) may be readily modified within the scope of the present invention. For example, the shield device (802) may be positioned between the first (108) and second magnetic members (110), or alternatively on the opposite side of the first magnetic member (108) to the second magnetic member (110) as shown in FIG. 8.

The inventor believes that it may be preferable to position the shield device (802) substantially as shown in FIG. 8 as it allows for a similar attenuation in the attraction force provided between the first (108) and second magnetic members (110), without needing to include the shield device (802) between the first magnetic member (108) and second magnetic member (110) where space is at a premium.

Preferably the shield device (802) comprises a nickel-iron alloy. Even more preferably the nickel-iron alloy comprises around 36% nickel and 64% iron; this particular alloy is known as Invar as discussed above in respect of the second magnetic member (110).

It is desirable for the shield device (802) to comprise the same alloy as the second magnetic member (110). Advantageously, the inventor believes that using the same alloy or at least alloys with similar permeability responses over the desired temperature range results in an at-least partial compensation for ambient temperature.

While the shield device (802) may provide a measure of ambient temperature compensation is it also envisages that a bi-metallic strip could be provided for the purpose of the ambient temperature compensation. In this configuration the deflection of the bi-metallic strip can provide compensation by acting upon the biasing means (106) or the second arm (104), or the magnetic attraction force provided by the first and second magnetic members (108, 110). This configuration still maintains the advantage of at least partially reducing the amount of bi-metallic material required in the switch.

Figure 9:
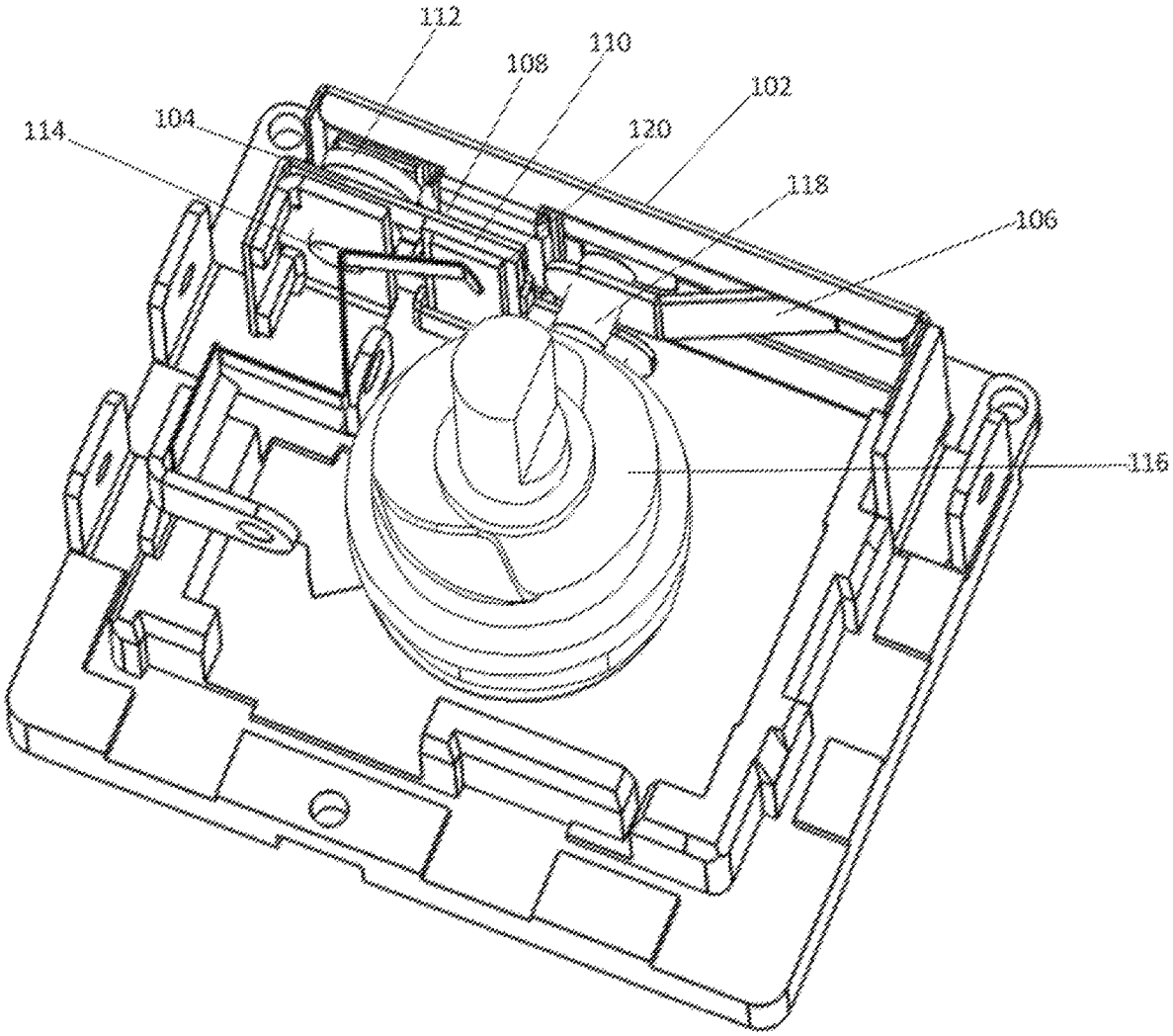
FIG. 9 shows a perspective view of the components of the embodiment of FIG. 1.

FIG. 9 illustrates a further perspective view of the components of the present invention.

Figure 10:
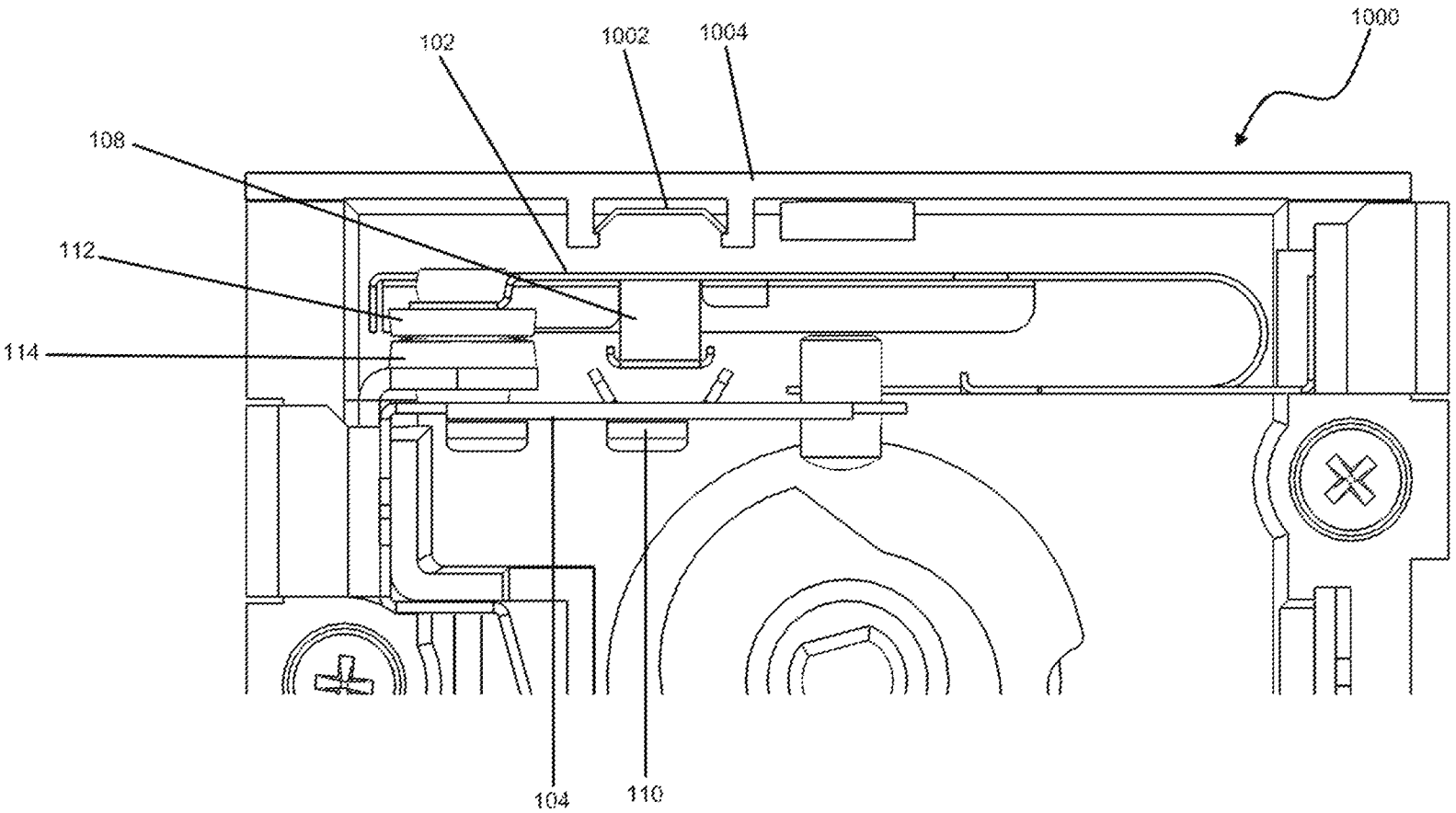
FIG. 10 shows an alternative embodiment of the invention illustrating the compensation for ambient temperature changes in a switch.

Referring now to FIG. 10 which illustrates a further method of compensating for ambient temperature changes in a switch (1000). In this embodiment, a third magnetic member (1002) is provided on an opposite opposing side of the first magnetic member (108) to provide an attraction force away from the second magnetic member (110).

Preferably the third magnetic member (1002), and the second magnetic member (110) are constructed at least in part from Invar as described in relation to the previous embodiments.

It will therefore be appreciated that any changes in temperature will affect the magnetic permeability of both the second (110) and third (1002) magnetic members.

For example, as the temperature increases the attraction force between the first magnetic member (108) and second magnetic member (110) reduces. This would ordinarily reduce the attraction force between the first arm (102) and second arm (104) which holds the first and second electrical contacts closed (112, 114). To overcome this net reduction in attraction force, the third magnetic member (1002) imparts a force to the first magnetic member (108) which opposes the attraction force provided by the second magnetic member (110).

In this configuration, as the temperature increases, the attraction force between the first magnetic member (108) and second magnetic member (110) reduces, however at the same time the attraction force towards the third magnetic member (1002) also reduces. This provides a measure of compensation to ambient temperature changes which can be used to ensure that the temperature at which the electrical contacts (112, 114) open and close, remains substantially constant as the ambient temperature changes.

One further advantage of the configuration shown in FIG. 10, is that the presence of the third magnetic member (1002) provides an improved "snap" action as the first arm (102) transitions between the open and closed states (as illustrated in FIGS. 3A and 3B respectively).

In FIG. 10 the third magnetic member (1002) is attached to a fixed mounting on the enclosure/housing (1004) of the switch (1000). It will be appreciated that this configuration is in no way limiting on the scope of the invention. For example, the third magnetic member (1002) may be adjustably connected to the enclosure/housing (1004) or any other suitable element of the switch. By allowing for adjustment of the location of the third magnetic member (1002) the associated attraction force may be adjusted to account for any manufacturing variations. Examples of suitable adjustment systems are provided herein and other suitable methods of providing positional adjustment will be known to those skilled in the art.

The entire disclosures of all applications, patents and publications cited above and below, if any, are herein incorporated by reference. Reference to any prior art in this specification is not, and should not be taken as, an acknowledgement or any form of suggestion that that prior art forms part of the common general knowledge in the field of endeavour in any country in the world.

The invention may also be said broadly to consist in the parts, elements and features referred to or indicated in the specification of the application, individually or collectively, in any or all combinations of two or more of said parts, elements or features. Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

Aspects of the present invention have been described by way of example only and it should be appreciated that modifications and additions may be made thereto without departing from the scope thereof of the appended claims.

What we claim is:

1. A switch device that includes:

a first magnetic member;

a second magnetic member;

a third magnetic member; and a heating device in thermal communication with one of the first and second magnetic members;

wherein, in use, the heating device is configured to heat the first or second magnetic member to reduce the attraction force between said first and second magnetic members, and further wherein the third magnetic member is structured and/or arranged to at least partially offset any variations in attraction force between the first and second magnetic members due to ambient temperature changes in the switch.

2. The switch device as claimed in claim 1, wherein the switch device further includes a first arm.

3. The switch device as claimed in claim 2, wherein the first magnetic member is provided to the first arm.

4. The switch device as claimed in claim 2, wherein the first arm comprises an electrical contact.

5. The switch device as claimed in claim 1, further comprising a second arm.

6. The switch device as claimed in claim 5, wherein the second magnetic member is provided to the second arm.

7. The switch device as claimed in claim 5, wherein the second arm comprises an electrical contact.

8. The switch device as claimed in claim 7, wherein the switch device further includes a first arm, wherein the first arm comprises an electrical contact, wherein the electrical contact of the first arm is configured to contact the electrical contact of the second arm in use to thereby complete an electrical circuit.

9. The switch device as claimed in claim 8, wherein the first magnetic member and second magnetic member are arranged to provide an attraction force which encourages connection of the electrical contact of the first arm to the electrical contact of the second arm.

10. The switch device as claimed in claim 1, wherein the first magnetic member includes a permanent magnet.

11. The switch device as claimed in claim 1, wherein the second magnetic member includes a ferromagnetic material.

12. The switch device as claimed in claim 11, wherein the ferromagnetic material includes an alloy of nickel and iron.

13. The switch device as claimed in claim 12, wherein the alloy includes approximately 36% nickel and approximately 64% iron.

14. The switch device as claimed claim 1, wherein the third magnetic member includes a ferromagnetic material.

15. The switch device as claimed in claim 14, wherein the ferromagnetic material includes an alloy of nickel and iron.

16. The switch device as claimed in claim 15, wherein the alloy includes approximately 36% nickel and approximately 64% iron.

17. The switch device as claimed in claim 1, further comprising a biasing means.

18. The switch device of claim 17, further comprising a second arm, wherein the second arm comprises an electrical contact, wherein the switch device further includes a first arm, wherein the first arm comprises an electrical contact, wherein the electrical contact of the first arm is configured to contact the electrical contact of the second arm in use to thereby complete an electrical circuit, and wherein the biasing means is configured to oppose a connection between the electrical contact of the first arm and the electrical contact of the second arm.

19. The switch device as claimed in claim 1, wherein the third magnetic member is configured to provide an attraction force which opposes the attraction force between the first and second magnetic members.

20. The switch device as claimed in claim 1, wherein the third magnetic member is configured to attenuate the attraction force between the first and second magnetic members.

21. The switch device as claimed in claim 1, wherein the third magnetic member is positioned between the first magnetic member and the second magnetic member.

22. The switch device as claimed in claim 1, wherein the second magnetic member is positioned on a first side of the first magnetic member, and the third magnetic member is positioned on a second side of the first magnetic member.

23. The switch device as claimed in claim 1, wherein the heating device is a ceramic heater.

24. A temperature regulation device comprising the switch device as claimed in claim 1.

* * * * *